US007334383B2

(12) United States Patent
Yamazaki et al.

(10) Patent No.: US 7,334,383 B2
(45) Date of Patent: Feb. 26, 2008

(54) PACKAGE AND METHOD OF FORMING THE PACKAGE

(75) Inventors: Junichi Yamazaki, Mishima (JP); Tetsuya Kusano, Susono (JP); Mizuho Imaruoka, Susono (JP); Satoshi Hasegawa, Numazu (JP); Kiyoshi Taniguchi, Numazu (JP); Takato Kiyohara, Mishima (JP); Naoki Nakatake, Numazu (JP)

(73) Assignee: Ricoh Co Ltd, Tokyo (JP)

( * ) Notice: Subject to any disclaimer, the term of this patent is extended or adjusted under 35 U.S.C. 154(b) by 127 days.

(21) Appl. No.: 11/191,217

(22) Filed: Jul. 28, 2005

(65) Prior Publication Data

US 2005/0284778 A1 Dec. 29, 2005

Related U.S. Application Data

(62) Division of application No. 10/327,963, filed on Dec. 26, 2002, now Pat. No. 6,983,840.

(30) Foreign Application Priority Data

Dec. 26, 2001 (JP) ..... 2001-395320
Mar. 14, 2002 (JP) ..... 2002-069617
Dec. 5, 2002 (JP) ..... 2002-354349

(51) Int. Cl.
*B65B 1/24* (2006.01)

(52) U.S. Cl. ..... 53/439; 53/582

(58) Field of Classification Search ..... 53/439, 53/399, 436, 582; 206/389, 522, 303, 443
See application file for complete search history.

(56) References Cited

U.S. PATENT DOCUMENTS 2,868,369 A * 1/1959 Webb ..... 242/160.2
3,186,543 A * 6/1965 Minick et al. ..... 206/393

(Continued)

FOREIGN PATENT DOCUMENTS

JP 61-003185 1/1986

(Continued)

OTHER PUBLICATIONS

U.S. Appl. No. 11/563,551, filed Nov. 27, 2006, Junichi Yamazaki, et al.

(Continued)

*Primary Examiner*—Sameh H. Tawfik
(74) *Attorney, Agent, or Firm*—Oblon, Spivak, McClelland, Maier & Neustadt, P.C.

(57) ABSTRACT

A package including an endless belt; a first cylindrical body contacting an inner surface of the endless belt at a first pressure; a second cylindrical body contacting another inner surface of the endless belt at a second pressure; and a third cylindrical body contacting an outer surface of the endless belt at a third pressure, wherein the endless belt is wound around the first, second and third cylindrical bodies while the first, second and third cylindrical bodies are arranged so as to be parallel to each other and substantially located in one plane, and wherein a surface of each of the first, second and third cylindrical bodies contacting the endless belt has a maximum height of from 0.8 to 150 μm when measured by a method based on JIS B 0601.

6 Claims, 8 Drawing Sheets

U.S. PATENT DOCUMENTS

| | | | | |
|---|---|---|---|---|
| 3,942,637 | A * | 3/1976 | Glennie | 206/389 |
| 4,162,009 | A | 7/1979 | Schouten | |
| 4,793,123 | A * | 12/1988 | Pharo | 53/449 |
| 4,811,839 | A | 3/1989 | Cornell et al. | |
| 5,137,152 | A | 8/1992 | Ogose et al. | |
| 5,282,345 | A | 2/1994 | Darcy et al. | |
| 5,400,121 | A | 3/1995 | Foote | |
| 5,417,322 | A | 5/1995 | Jeran et al. | |
| 5,839,839 | A | 11/1998 | Brot et al. | |
| 6,370,843 | B1 * | 4/2002 | Bercaits et al. | 53/436 |
| 7,059,101 | B2 * | 6/2006 | Dextraze et al. | 53/399 |
| 2005/0284778 | A1 | 12/2005 | Yamazaki et al. | |

FOREIGN PATENT DOCUMENTS

| | | |
|---|---|---|
| JP | 08-006436 | 1/1996 |
| JP | 09-319259 | 12/1997 |

OTHER PUBLICATIONS

U.S. Appl. No. 11/524,379, filed Sep. 21, 2006, Taniguchi, et al.
U.S. Appl. No. 11/627,175, filed Jan. 25, 2007, Kusano.

* cited by examiner

PACKAGE AND METHOD OF FORMING THE PACKAGE

CROSS REFERENCE TO RELATED APPLICATION

This application is a division of patent application Ser. No. 10/327,963, filed Dec. 26, 2002, now U.S. Pat. No. 6,983,840 the entire contents of which are incorporated herein by reference. The present document incorporates by reference the entire contents of Japanese priority documents 2001-395320, filed Dec. 26, 2001, application Ser. No. 2002-069617, filed Mar. 14, 2002 and application Ser. No. 2002-354349, filed Dec. 5, 2002.

BACKGROUND OF THE INVENTION

1. Field of the Invention

The present invention relates to a package and a method of packing endless belts, and more particularly to a package and a method of packing belt-shaped photoreceptors, intermediate transfer belts, feeding belts, etc. for use in an electrophotographic apparatus.

2. Discussion of the Background

Electrophotographic technologies are widely used for, e.g.,printers connected with facsimiles and personal computers as well as copiers, and particularly their high-resolution and full-color images are eminently progressed in recent times. In addition, on-demand printers using the electrophotographic technologies come into the market.

In electrophotographic apparatuses using the electrophotographic technologies, various belts such as belt-shaped electrophotographic photoreceptors, intermediate transfer belts and feeding belts are used. Recent technology regarding these belts is discussed in, e.g., "Digital Hardcopy Technology" published by Kyoritsu Shuppan Kabushiki Kaisha on Nov. 15, 2000 (Nonpatent Literature 1).

As this literature mentions, the recent full-color, high-resolution, high-speed electrophotographic apparatus or on-demand printing electrophotographic apparatus has a belt-shaped electrophotographic photoreceptor, an intermediate transfer belt or a feeding belt, which have a long peripheral length. In addition, in such an apparatus, the belt-shaped electrophotographic photoreceptor, intermediate transfer belt or feeding belt is required to have extremely high uniformity and smoothness.

For example, when the belt-shaped electrophotographic photoreceptor has a concavity and convexity, an image development irregularity occurs in the image developing process, resulting in a problem of partly faded or diminished images.

In addition, when the intermediate transfer belt has a concavity and convexity, an image development irregularity occurs in an image developing process, resulting in a problem of partly faded or diminished images as well. When the feeding belt has a concavity and convexity, a feeding displacement occurs, resulting in image displacements. As mentioned above, in the recent electrophotographic apparatuses, a belt-shaped electrophotographic photoreceptor, an intermediate transfer belt, a feeding belt or the like is required to have high uniformity and smoothness. Accordingly, these belts are required not to have a concavity and convexity or a damage when stored or transported.

The following conventional methods of packing these belts are suggested and disclosed. For example, Japanese Patent Publication No. 3-44299 discloses a method of covering the entire surface of an endless belt-shaped photoreceptor with a releasable light-shield protection sheet. Japanese Laid-Open Patent Publication No. 8-6436 discloses a method of using a flat plate material having a cut as a buffer material to fix a photoreceptor. Japanese Laid-Open Patent Publication No. 9-269624 discloses a method of perpendicularly containing a photoreceptor belt, in which the belt is held in the air in a container with an elastically deformable core material inserted into an inside portion of the belt, which is longer than a width portion of the belt to prevent its edge from bending, and further a protection sheet is wound around an outside of the belt. Japanese Laid-Open Patent Publication No. 9-319259 discloses a method of winding a nonwoven fabric made of a synthetic fiber around a photoreceptor belt as a protection sheet. However, although these methods are effective for packing a conventional belt having a short peripheral length, e.g., of not longer than 500 mm, none of them are sufficient for packing a belt having a long peripheral length. Namely, even when a photoreceptor belt, an intermediate transfer belt or a feeding belt having a peripheral length of not longer than 500 mm are packed in a box as they are, although they occupy a large area thereof, they can be stored and transported without having a concavity and convexity or without damage.

However, when the belt has a long peripheral length, e. g., longer than 500 mm, the packing container becomes too large or the belt is shaken and abraded so as to be damaged while being transported. As a method of packing a belt having a long peripheral length without such problems, the following method is conventionally used:

(1) three (paper) tubes which are as long as a width of a belt or longer than the width thereof are prepared;

(2) the belt is expanded to the maximum and a first tube and a second tube are put inside at each end of the belt;

(3) a third tube is put on the belt surface at either end thereof; and (4) the belt is wound toward the other end thereof until the three tubes become lined up.

This packing method is actually used for Ricoh Imagio MF530, etc.

However, the present inventors found that the following two problems can occur even in this method.

One is that the paper tube typically used in this method and is a so-called spiral paper tube-which is formed by obliquely winding a tape-shaped paper with an adhesive around a mandrel because it has a low production cost, and the spiral paper tube obliquely has a slight concavity and convexity on a surface thereof. Conventionally, the spiral paper tube is used for packing belts such as photoreceptor belts, and even though the belts consequently has a slight concavity and convexity or a damage, the resultant images are not affected. However, in the recent high-quality, high-resolution and full-color image electrophotographic apparatus, even such a concavity and convexity of a photoreceptor is not conventionally a problem which affects the resultant images. Specifically, in a halftone image, the image density fades in the shape of an oblique stripe having a width of a few mm because the photoreceptor belt has a concavity and convexity. Although the concavity and convexity is very slight, it can be found by putting the belt on a flat desk without tension and observing reflected light from a surface thereof using an illumination on a ceiling.

The other problem is that when the above-mentioned packing method using three tubes is used, a portion between the tubes is slightly damaged on occasion. For example, when a belt shaped photoreceptor is packed using three paper tubes A, B and C, the photoreceptor surface between the paper tubes A and B has a linear damage. In addition, the surface between the paper tubes B and C also has a linear damage. This damage is so slight that it is not a problem for the conventional electrophotographic apparatus, but is a serious problem for recent high-quality, high-resolution and full-color image electrophotographic apparatuses. Specifically, in a halftone image, the image density fades in the shape of an oblique stripe having a width of a few mm because the photoreceptor belt has a concavity and convexity or is damaged. Although the concavity and convexity or the damage is very slight, it can be found by putting the belt on a flat desk without tension and observing reflected light from a surface thereof using an illumination on a ceiling.

Because of these reasons, a need exists for a package and a method of packing endless belts such as belt-shaped photoreceptors, intermediate transfer belts and feeding belts used in the recent high-quality, high-resolution and full-color image electrophotographic apparatuses without the occurrence of a concavity and convexity, an undesirable habitual characteristic (i.e., a habit) or being damaged.

SUMMARY OF THE INVENTION

Accordingly, an object of the present invention is to provide a package and a method of packing endless belts such as belt-shaped photoreceptors, intermediate transfer belts and feeding belts used in the recent high-quality, high-resolution and full-color image electrophotographic apparatus without the occurrence of a concavity and convexity, a habit or being damaged.

Briefly this object and other objects of the present invention as hereinafter will become more readily apparent can be attained by a package including an endless belt; a first cylindrical body contacting an inner surface of the endless belt; a second cylindrical body contacting another inner surface of the endless belt; and a third cylindrical body contacting an outer surface of the endless belt, wherein the endless belt is wound around the first, second and third cylindrical bodies while the first, second and third cylindrical bodies are arranged so as to be parallel to each other and substantially located in one plane, and wherein a surface of each of the first, second and third cylindrical bodies contacting the endless belt has a maximum height of from 0.8 to 150 μm when measured by a method based on JIS B 0601.

In addition, an object of the present invention can also be attained by a package including an endless belt; a first cylindrical body contacting an inner surface of the endless belt; a second cylindrical body contacting another inner surface of the endless belt, wherein the endless belt is wound around the first and second cylindrical bodies while they are arranged so as to be parallel to each other and substantially located in one plane and, and wherein a surface of each of the first and second cylindrical bodies contacting the endless belt has a maximum height of from 0.8 to 150 μm when measured by a method based on JIS B 0601.

Further, an object of the present invention can also be attained by a package including an endless belt; a first cylindrical body contacting an outer surface of the endless belt; and a second cylindrical body contacting an inner surface of the endless belt, wherein the endless belt is wound around the first and second cylindrical bodies while they are arranged so as to be parallel to each other and substantially located in one plane and, and wherein a surface of each of the first and second cylindrical bodies has a maximum height of from 0.8 to 150 μm when measured by a method based on JIS B 0601.

These and other objects, features and advantages of the present invention will become apparent upon consideration of the following description of the preferred embodiments of the present invention taken in conjunction with the accompanying drawings.

BRIEF DESCRIPTION OF THE DRAWINGS

Various other objects, features and attendant advantages of the present invention will be more fully appreciated as the same becomes better understood from the detailed description when considered in connection with the accompanying drawings in which like reference characters designate like corresponding parts throughout and wherein.

DETAILED DESCRIPTION OF THE PREFERRED EMBODIMENTS

Figure 1A:
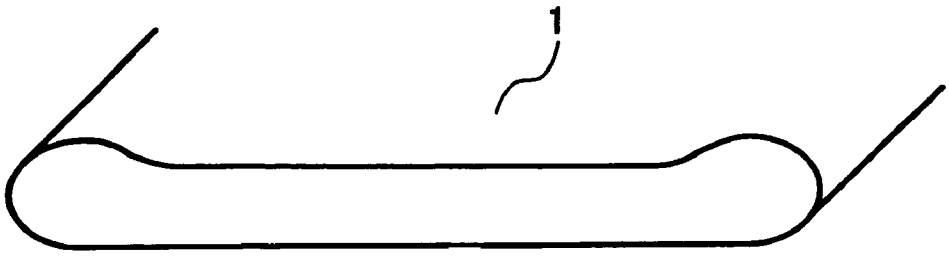
FIGS. 1A to 1F are schematic views illustrating a method of packing an endless belt of the present invention.

Generally, the present invention provides a package and a method of packing endless belts such as belt-shaped photoreceptors, intermediate transfer belts and feeding belts used in the recent high-quality, high-resolution and full-color image electrophotographic apparatus without the occurrence of a concavity and convexity or being damaged.

An endless belt which is a packing object of the present invention includes an electrophotographic photoreceptor belt, an intermediate transfer belt, a fixing belt and a feeding belt used in an electrophotographic apparatus. These belts have substrates formed of a plastic such as polyethylene phthalate, polybutyleneterephthalate, polyimide and nylon, on the surface of which a photosensitive or an electroconductive layer is formed.

A first embodiment of a package of the present invention includes an endless belt; a first cylindrical body A inserted into an innermost end of the endless belt; a second cylindrical body B inserted into the other innermost end thereof; and a third cylindrical body C located at an outermost end thereof in parallel with the first cylindrical body A, wherein the endless belt is wound around the first and third cylindrical bodies A and C. The cylindrical bodies A, B and C are preferably located on an identical plane.

In the present invention, an innermost end of an endless belt (hereinafter referred to as a belt) means an innermost end of the belt when wound, and an outermost end of the belt means an outermost end of the belt when wound.

Each of the three cylindrical bodies constituting the first embodiment of a package of the present invention has a surface maximum height (Rmax) of from 0.8 to 150 μm, wherein the maximum height (Rmax) is defined in JIS B0601. The lower the maximum height (Rmax), the more preferable, but the production cost of such a cylindrical body is high. When the maximum height (Rmax) is higher than 250 μm, an endless belt using the cylindrical body occasionally has a concavity and convexity, a step or a habit. The endless belt does not have such a concavity and convexity in a few minutes or hours after packed, but have them in a few days and they do not disappear once they appear even if the cylindrical bodies are removed. In this respect, the maximum height (Rmax) is preferably from 0.8 to 120 μm, and more preferably from 0.8 to 80 μm.

The cylindrical body for use in the present invention preferably has an outer cylindricality of from 10 to 500 μm. The smaller the cylindricality, the more preferable, but a production cost of such a cylindrical body becomes higher. When the cylindricality is larger than 500 μm, the endless belt occasionally has a concavity and convexity, a step or a habit. The cylindrical body preferably has a circularity defined in JIS B0631 of from 10 to 300 μm. The smaller the circularity, the more preferable, but the production cost of the cylindrical body having smaller circularity becomes higher. When the circularity is larger than 500 μm, the endless belt occasionally has a concavity and convexity, a step or a habit.

The cylindrical body preferably has an outer diameter of from 20 to 250 mm. When a package constituted of the cylindrical body having such a diameter, a strong bending habit of the endless belt can be prevented. When the outer diameter is less than 20 mm, the endless belt occasionally has a strong bending habit. When larger than 120 mm, the package volume is too large. In this respect, the cylindrical body more preferably has an outer diameter of from 40 to 120 mm, and furthermore preferably from 60 to 80 mm.

The cylindrical body is preferably longer than a width of the endless bell. The cylindrical body is preferably longer by 5 to 100 mm, and more preferably by 30 to 80 mm. Such a cylindrical body pan hold the endless belt without shaking the same.

Specific examples of the cylindrical body for use in the present invention include cylindrical bodies made of a paper, a paper including a resin, a plastic, etc. When the cylindrical body made of a paper or a paper including a resin is used, the smoothed cylindrical body having a spiral shape and a surface maximum height (Rmax) as defined in JIS B0601 of from 0.8 to 150 μm can be used. The smoothing method includes various methods such as a method of pressing or polishing the surface.

The cylindrical body made of a plastic can be formed by an extrusion or an injection method, and specific examples of the material include various resins such as an acrylic resin, a polyethylene resin, a vinylchloride resin and a styrol resin.

In the present invention, at least one of the three cylindrical bodies used in the first embodiment of a package may be removed and a cylindrical body having a smaller outer diameter instead of the cylindrical body may be reinserted. This can reduce a contact pressure between the endless belt and the cylindrical body.

In the package of the present invention, a distance between each cylindrical body, i.e., the distance between the cylindrical bodies A and B, the distance between the cylindrical bodies B and C and the distance between the cylindrical bodies C and A, is preferably not less than a value (L) determined by the following formula (1):

$$L=2\times T\times(n+1) \quad (1)$$

wherein T is a thickness of the endless belt and n is a winding number of the belt. When the distance among each cylindrical body is less than L, the endless belt occasionally has a concavity and convexity, a step and a habit.

A second embodiment of the package of the present invention includes an endless belt; a first cylindrical body A inserted into an innermost end of the endless belt; and a second cylindrical body B inserted into the other innermost end thereof, wherein the endless belt is wound around the first cylindrical body A while being loosened between the first and the second cylindrical bodies A and B. In the second embodiment of a package, the fact that the belt is loosened between the first and the second cylindrical bodies A and B means that there is a space within which a cylindrical can be inserted between the cylindrical bodies A and B, and consequently there is a slight concavity of the belt therebetween. Since this can reduce a contact pressure between the two cylindrical bodies and the endless belt, it can effectively be prevented that a concavity and convexity or a step present on a surface of the cylindrical body leaves a concavity and convexity, a step or a habit on the endless belt.

In the second embodiment of the package, the distance between the cylindrical bodies A and B, which is almost equivalent to the diameter of the cylindrical body forms the loosened part of the endless belt. The loosened part can easily be formed by removing the cylindrical body C from the first embodiment of a package.

The two cylindrical bodies constituting the second embodiment of the package has a surface maximum height (Rmax) of from 0.8 to 150 μm as the first embodiment does, which is defined In JIS B0601.

The two cylindrical bodies constituting the second embodiment of a package are preferably similar cylindrical bodies used in the first embodiment.

A third embodiment of a package of the present invention includes an endless belt; a first cylindrical body C located at an outermost end of the endless belt; and a second cylindrical body B inserted into the other innermost end thereof, wherein the endless belt is wound around the first cylindrical body C while loosed between the first and the second cylindrical bodies B and C. In the third embodiment of a package, the belt is loosened between the first and the second cylindrical bodies B and C which means that there is a space within which a cylindrical can be inserted between the cylindrical bodies B and C, and consequently there is a slight concavity of the belt therebetween. Since this can reduce a contact pressure between the two cylindrical bodies and the endless belt, it can effectively be prevented that a concavity and convexity or a step present on a surface of the cylindrical body leaves a concavity and convexity, a step or a habit on the endless belt.

The cylindrical body C located at an outermost end of the endless belt means a cylindrical body located from an innermost end of the belt in parallel therewith in the space within which a cylindrical body can be inserted.

In the third embodiment of a package, a distance between the cylindrical bodies B and C, which is almost equivalent to a diameter of the cylindrical body forms the loosed part of the endless belt. The loosed part can easily be formed by removing the cylindrical body C from the first embodiment of a package. The two cylindrical bodies constituting the third embodiment of a package has a surface maximum height (Rmax) of from 0.8 to 150 μm as the first embodiment does, which is defined In JIS B0601.

The two cylindrical bodies constituting the third embodiment of a package are preferably similar to the cylindrical bodies used in the first embodiment.

The contact pressure between the endless belt and the cylindrical body in any of the first to third embodiments of a package of the present invention is preferably from 100 Pa to 0.2 MPa, more preferably from 200 Pa to 0.1 MPa, and furthermore preferably from 300 Pa to 0.05 MPa. When the contact pressure is less than 100 Pa, the endless belt is not tightly packed on occasion. When greater than 0.2 MPa, the belt cannot occasionally be stored without a concavity and convexity or a habit occurring.

In the present invention, the contact pressure between the endless belt and the cylindrical body is measured by Prescale for an extremely ultralow pressure (LLLW), an ultralow pressure (LLW) and a low pressure (LW) from Fuji Photo Film Co., Ltd. Since the Prescale has a measurable minimum of 0.2 MPa and cannot measure less than 0.2 MPa, the above-mentioned 100 Pa is supposed from a gravity.

Specific examples of the endless belt constituting the package of the present invention include an electrophotographic photoreceptor belt, an intermediate transfer belt, a feeding belt and a fixing belt. These belts are endless belts included in an electrophotographic apparatus and will be explained later in detail.

Next, a first method of forming the package of the present invention will be explained. The first method of forming the package can easily form the above-mentioned package of the first embodiment.

In the first method of forming the package, an endless belt is expanded to the maximum, cylindrical bodies A and B are inserted into both inside ends of the belt, a cylindrical body C is put on the belt next to the cylindrical body A in parallel therewith, and the cylindrical bodies C and A are rotated together toward the cylindrical body B to wind the endless belt around the cylindrical bodies C and A. Thus the package is formed.

The first method of forming the package will be specifically explained, referring to the FIGS. 1A to 1F.

First, an endless belt 1 is put on a table (FIG. 1).

Figure 1B:
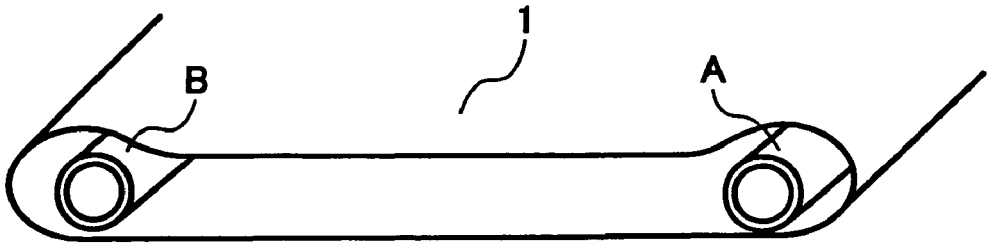

Next, cylindrical bodies A and B are inserted into both inside ends of the belt (FIG. 1B).

Figure 1C:
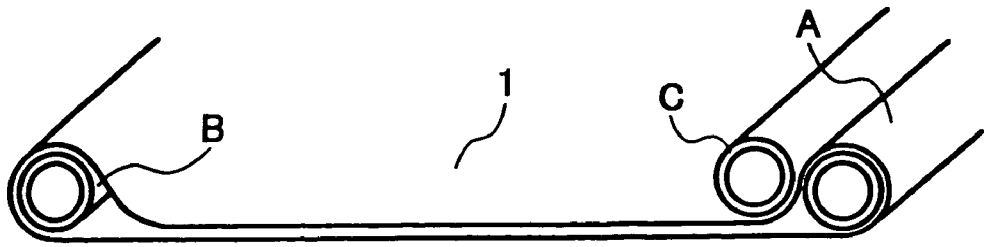

Next, a cylindrical body C is put on the belt 1 next to the cylindrical body A in parallel therewith (In FIG. 1C, the cylindrical body C is put on the left of the cylindrical body, A).

Figure 1D:
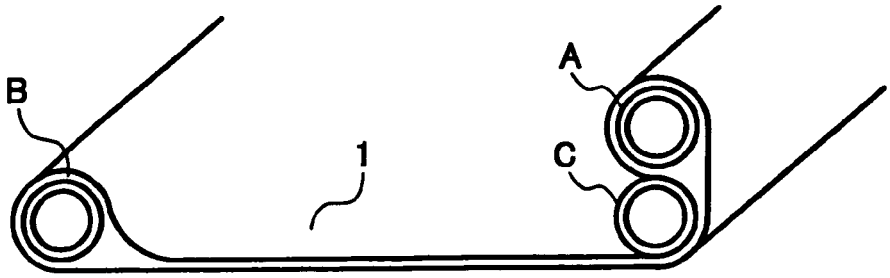
Figure 1E:
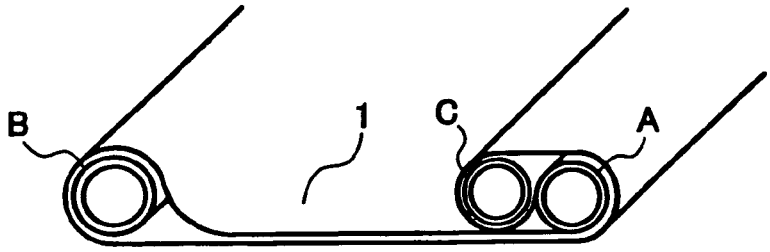

Then, the cylindrical bodies C and A are rotated together toward the cylindrical body B to wind the belt 1 around the cylindrical bodies C and A (FIGS. 1D and 1E).

Figure 1F:
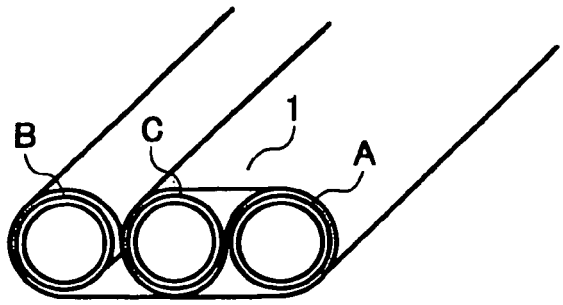

Thus, winding the belt 1 is finished and the package is completed as shown in FIG. 1F. However, the present invention is not limited thereto and the cylindrical body C may be put next to the cylindrical body B and the cylindrical bodies B and C may be rotated toward the cylindrical body A to wind the belt 1. When the belt 1 is wound in this method, a thin paper maybe put on the belt and wound together therewith in order to prevent damage to the surface of the belt.

In the method of the present invention, the cylindrical bodies C and A are preferably rotated together toward the cylindrical body B to wind the belt 1 around the cylindrical bodies C and A such that a distance among each cylindrical body is not less than a value (L) determined by the following formula (1)

$$L=2\times T\times(n+1) \quad (1)$$

wherein T is a thickness of the endless belt and n is a winding number of the belt. Specifically, the belt 1 is preferably wound such that the distance between surfaces of the cylindrical bodies A and C is not less than L.

Figure 3A:
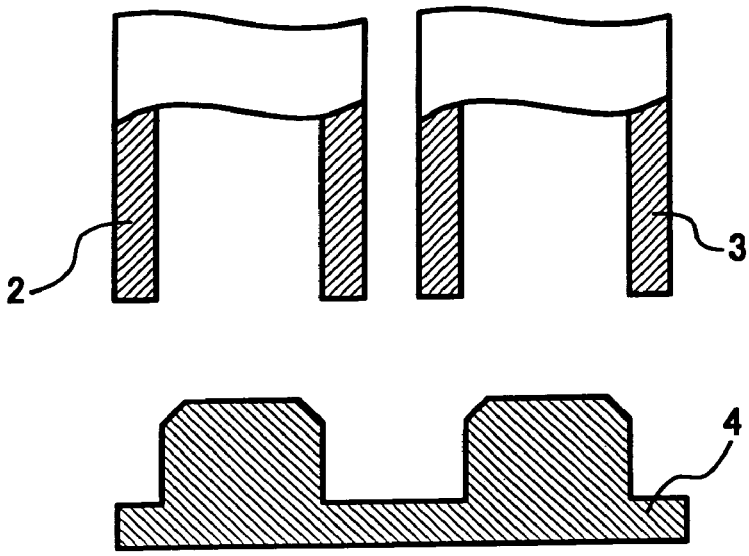
FIGS. 3A and 3B are schematic views illustrating a spacer for use in the present invention.
Figure 3B:
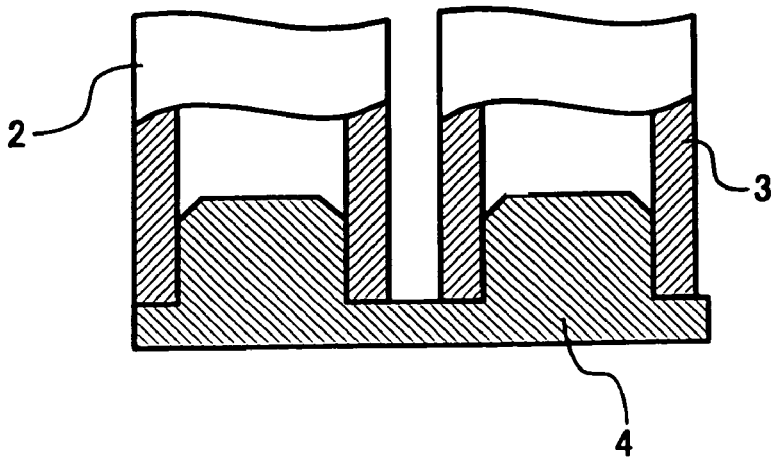

As a method of winding the belt 1 around the cylindrical bodies C and A such that the distance between surfaces of the cylindrical bodies A and C is not less than L, as shown in FIGS. 3A and 3B, the cylindrical bodies C and A are preferably rotated toward the cylindrical body B to wind the belt 1 around the cylindrical bodies C and A while keeping a desired distance therebetween with a spacer 4 capable of keeping a fixed distance among the cylindrical bodies.

FIGS. 3A and 3B are schematic views illustrating a cross section of the spacer 4 before and after inserted into the cylindrical bodies C and A. FIG. 3A is a schematic view illustrating a cross section of the spacer 4 before being inserted into the cylindrical bodies C and A. FIG. 3B is a schematic view illustrating a cross section of the spacer 4 after being inserted into the cylindrical bodies C and A.

The spacer 4 can be made of various materials such as a polycarbonate resin, a styrol resin, a nylon resin, a polyethylene resin or a metal such as aluminium.

Figure 4:
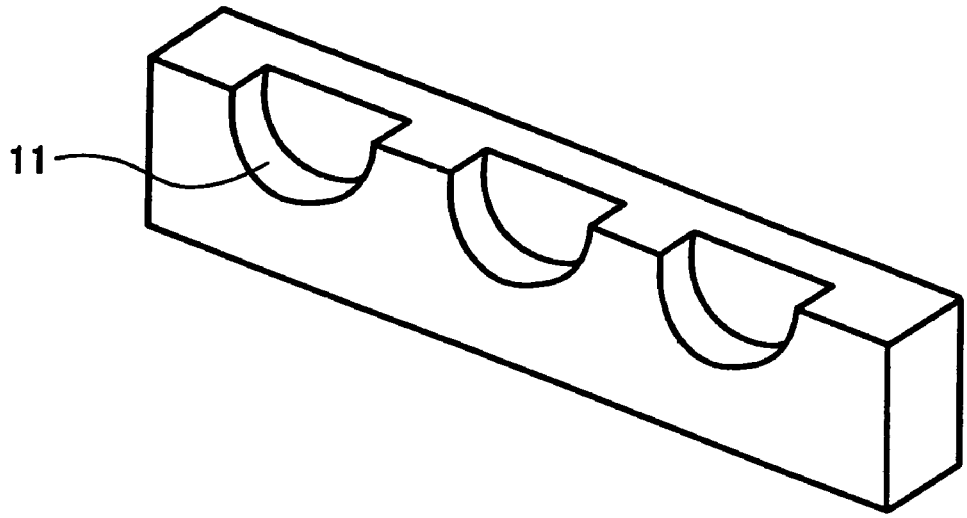
FIG. 4 is a schematic view illustrating an embodiment of a packing buffer for use in the present invention.
Figure 5:
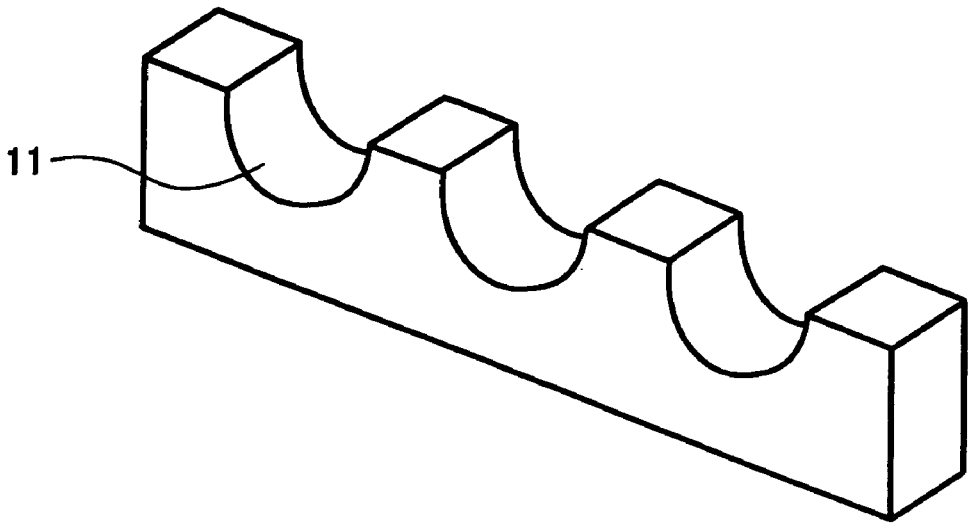
FIG. 5 is a schematic view illustrating another embodiment of a packing buffer for use in the present invention.

It is preferable that the thus prepared package is fixed with a packing buffer having a concavity 11 as FIGS. 4 and 5 show by fixing an end of the cylindrical body in the concavity 11, and that the fixed package is further put in a box.

When the package of the present invention is packed using the packing buffer having a concavity, the cylindrical body is preferably longer than a width of the belt as mentioned above. The cylindrical body is preferably longer by 5 to 100 mm, and more preferably by 30 to 80 mm. When a part of such a cylindrical body coming out of the belt is put on the concavity 11 shown in FIGS. 4 and 5, the belt and the cylindrical body can be fixed without a shake.

Figure 6:
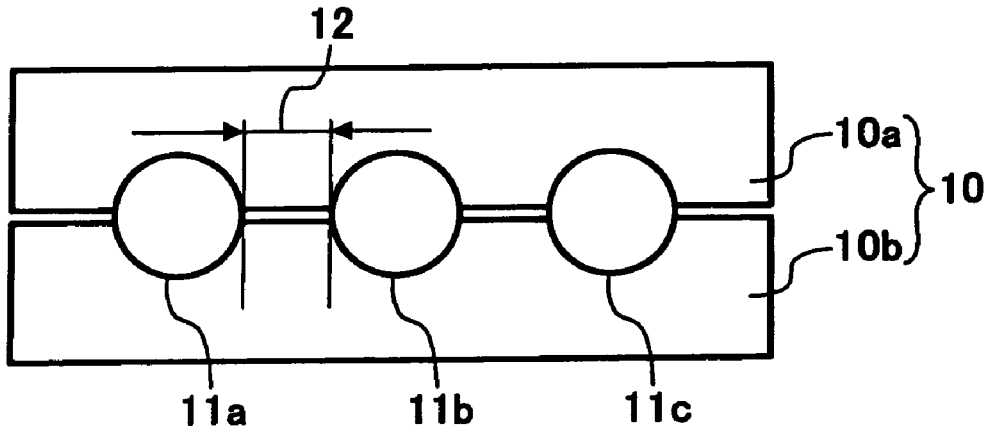
FIG. 6 is a schematic view illustrating still another embodiment of a packing buffer for use in the present invention.

As the packing buffer, as FIG. 6 shows, a packing buffer 10 including buffer members 10*a* and 10*b* is preferably used. The packing buffer 10 has concavities 11*a*, 11*b* and 11*c* into which the end of the cylindrical body is inserted. A distance 12 among the concavities 11*a*, 11*b* and 11*c* is preferably longer than the above-mentioned value L. When the package of the present invention is packed with the packing buffer 10, there is a preferable distance between the endless belt and the cylindrical body, and the belt can be packed without strongly contacting the cylindrical body. Therefore, even when the belt is stored for a long time using the packing buffer 10, the belt does not have a concavity and convexity or a habit due to a concavity and convexity on the surface of the cylindrical body. In this respect, the distance 12, i.e., the distance among the cylindrical bodies is preferably longer than L by not less than 1 mm, and more preferably by not less 3 mm.

In the present invention, the two or four packing buffers shown in FIGS. 4 and 5 can be used for one endless belt. When the two packing buffers are used, both ends of the cylindrical body are held thereby from underneath. When the four packing buffers are used, both ends of the cylindrical body are sandwiched thereby. However, when the two packing buffers shown in FIGS. 4 and 5 are used, the concavities 11 need to be deep.

Figure 7:
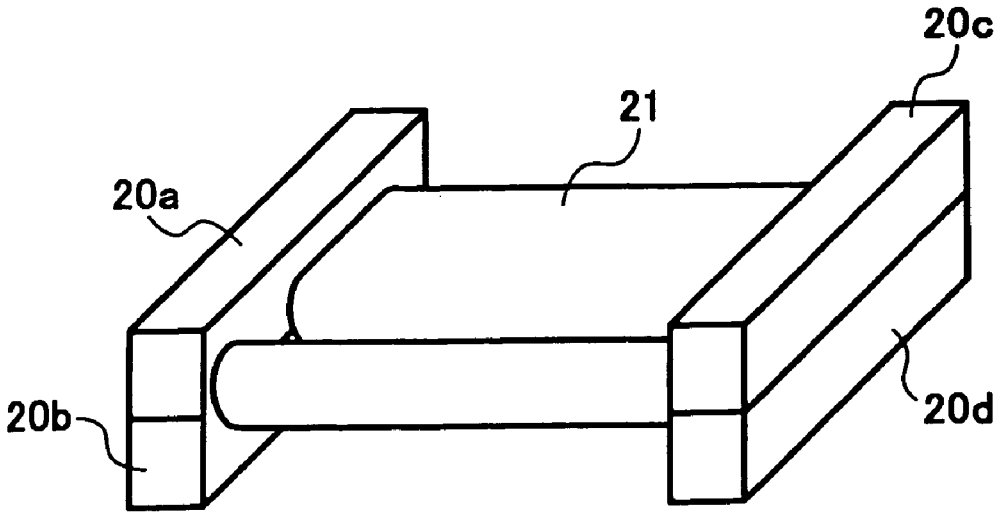
FIG. 7 is a schematic view illustrating an embodiment of an additional packed package of the present invention.
Figure 8:
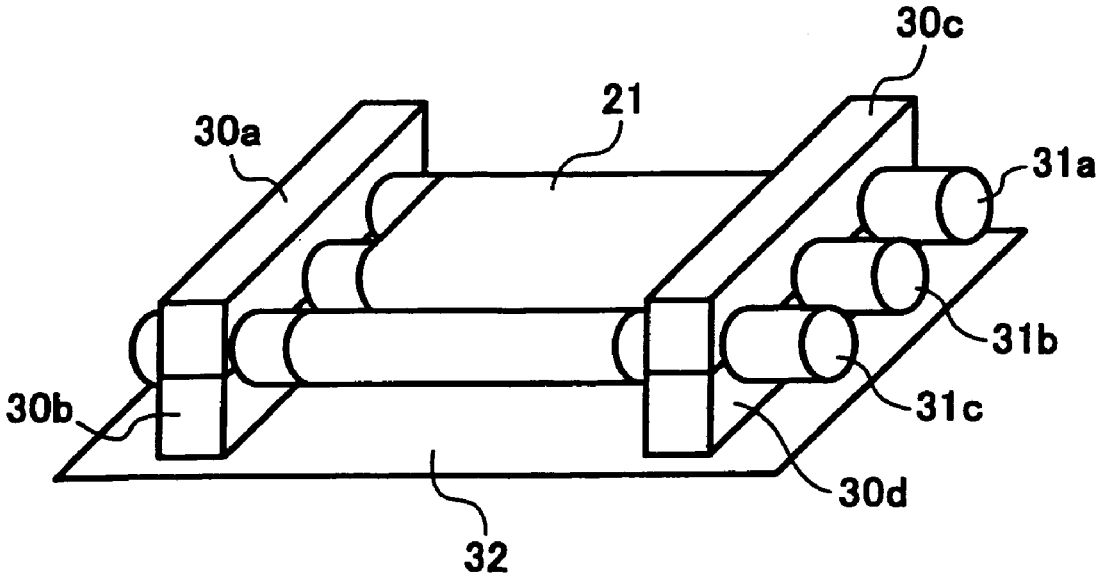
FIG. 8 is a schematic view illustrating another embodiment of a further packed package of the present invention.

An embodiment of a package using the four packing buffers in FIG. 4 is shown in FIG. 7, and an embodiment of a package using the four packing buffers in FIG. 5 is shown in FIG. 8. In FIG. 7, numerals 20*a*, 20*b*, 20*c* and 20*d* denote packing buffers in FIG. 4 and numeral 21 represents a packed endless belt. In FIG. 8, numerals 30*a*, 30*b*, 30*c* and 30*d* are packing buffers in FIG. 5 and numeral 21 is a packed endless belt, and numeral 32 is a table the packing buffers are positioned on. The packing buffers 30*b* and 30*d* may be fixed by means such as an adhesive or may not be fixed.

The packing buffers can be made of various materials such as a polystyrene foam, paper and cardboard.

Next, a second method of forming the package of the present invention will be explained. The second method of forming the package can easily form the above-mentioned package of the second or third embodiment.

In the second method of forming the package, an endless belt is expanded to the maximum, cylindrical bodies A and B are inserted into both inside ends of the belt, a cylindrical body C is put on the belt next to the cylindrical body A in parallel therewith, and the cylindrical bodies C and A are rotated together toward the cylindrical body B to wind the endless belt around the cylindrical bodies C and A. Then, the cylindrical body C or A is removed to form the package.

The second method of forming the package will be specifically explained, referring to the FIGS. 1A to 1F and 2A to 2B.

In the second method of forming the package, as FIGS. 1A to 1F show, a package including cylindrical bodies A to C and an endless belt 1 is prepared first (FIG. 1F).

Figure 2A:
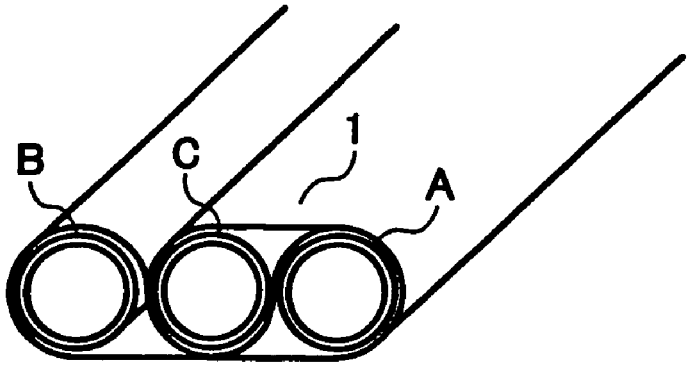
FIGS. 2A and 2B are schematic views illustrating another method of packing an endless belt of the present invention.

Next, as FIG. 2A shows, the cylindrical body C sandwiched by the cylindrical bodies A and B is removed to form the second embodiment of a package (FIG. 2A). According to the length of the endless belt 1, the cylindrical body A is occasionally sandwiched by the cylindrical bodies C and B, which is different from FIG. 1F and FIG. 2A. Then, the cylindrical body A sandwiched by the cylindrical bodies C and B is removed to form the third embodiment of a package (not shown). When the cylindrical body located in the middle is removed in this manner, excessive tension is not applied to the belt. Therefore, even when the belt in the package is stored for a long time, the belt does not have a concavity and convexity or a habit due to a concavity and convexity on the surface of the cylindrical body.

Figure 2B:
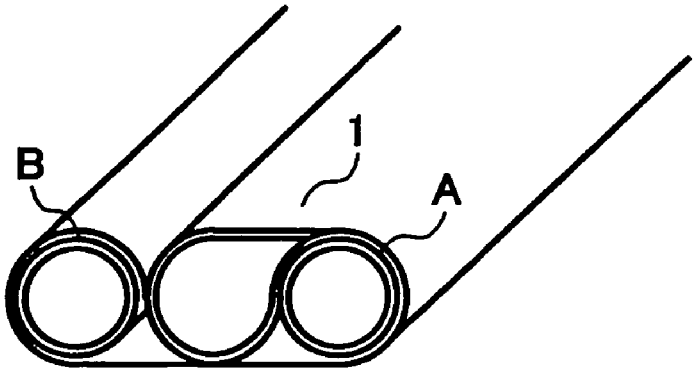

FIG. 2A is a schematic view illustrating a package before the cylindrical body C is removed and FIG. 2B is a schematic view illustrating the package after the cylindrical body C is removed.

Figure 9:
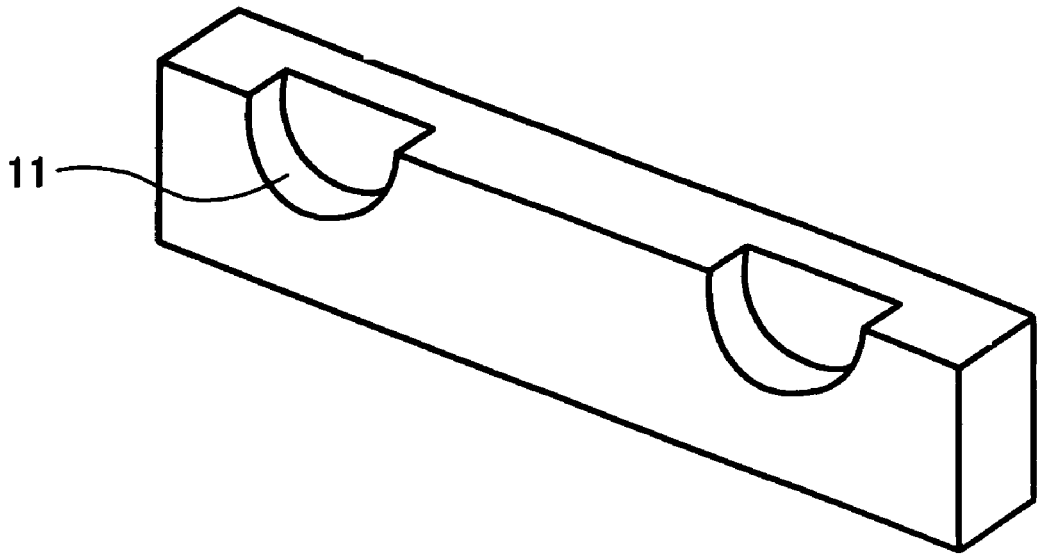
FIG. 9 is a schematic view illustrating a still further embodiment of a packing buffer for use in the present invention.

As it is preferable in the package prepared by the first method of forming a package, it also is preferable that the thus prepared package by the second method of forming a package is fixed with a packing buffer having a concavity 11 as FIG. 9 shows by fixing an end of the cylindrical body in the concavity 11, and that the fixed package is further put in a box.

The packing buffer for use in the second method of forming a package is preferably similar to those for use in the first method of forming a package. The two or four packing buffers may be used for one endless belt.

In the present invention, it is preferable that the package is further packed with a packing buffer and a box, and that a position of the cylindrical body is regulated such that the position thereof does not move. As a method of regulating the position of the cylindrical body, any method regulating the position without causing damage to a photoreceptor belt can be used, such as setting a stopper in the box or having the buffer have a stopper. The rotation of the cylindrical body is preferably regulated as well as the position thereof.

In the present invention, the package fixed with the packing buffer in FIG. 7 or 8 is preferably put in a container such as a cardboard container as is or after being put in a plastic bag. In the present invention, when the endless belt is a belt-shaped electrophotographic photoreceptor, a light blocking paper or film is effectively used to cover or wrap the belt in order to prevent deterioration of the photoreceptor due to light. When the endless belt is a belt which is vulnerable to humidity such as a belt-shaped electrophotographic photoreceptor, an intermediate transfer belt and a feeding belt, the packed belt is effectively put in a bag made of a polyethylene film in order to improve moisture resistance thereof.

A photoreceptor belt, an intermediate transfer belt, a fixing belt and a feeding belt are preferably packed by the packing method of the present invention, and the belts will be explained.

1. Electrophotographic Photoreceptor Belt

As an electroconductive substrate for the photoreceptor belt for use in the present invention, a plastic film subjected to an electroconductive treatment is used. Specific examples of the substrate include plastic films such as polyester, polycarbonate and polyimide, on which a thin film of an electroconductive material such as metals, e.g., Al, Ag and Au or $In_2O$ and $SnO_2$ is formed.

An undercoat layer can optionally be formed between the substrate and an adjacent charge transport layer or a charge generation layer. Specific examples of a resin for use in the undercoat layer include polyamide, polyurethane, polyester, epoxy resins, polyketone, polycarbonate, silicone resins, acrylic resins, polyvinylbutyral, polyvinylformal, polyvinylketone, polystyrene, poly-N-vinylcarbazole and polyacrylamide. Further, a white pigment such as a titanium oxide, a sulfonic acid or an alkali metallic salt thereof, an anion electroconductive polymer such as an ammonium salt, etc can be included therein. The undercoat layer preferably includes an insoluble material with a solvent for use in a liquid for forming a layer overlying the undercoat layer.

An endless belt-shaped photoreceptor of the present invention may have a single-layered photosensitive layer or multi-layered photosensitive layer including a charge generation layer and a charge transport layer.

The charge generation layer includes a charge generated material or a combination of a charge generation material are a binder resin, and preferably has a thickness of from 0.05 to 3 μm.

Specific examples of the charge generation materials include CI Pigment Blue 25 (Color Index CI 21180), CI Pigment Red 41 (CI 21200), CI Acid Red 52 (CI 45100), CI Basic Red (CI 45210), azo pigments having a carbazole skeleton (disclosed in Japanese Laid-Open Patent Publication No. 53-95033), azo pigments having a distyrylbenzene skeleton (disclosed in Japanese Laid-Open Patent Publication No. 53-133445), azo pigments having a triphenylamine skeleton (disclosed in Japanese Laid-Open Patent Publication No. 53-132347), azo pigments having a dibenzothiophene skeleton (disclosed in Japanese Laid-Open Patent Publication No. 54-21728), azo pigments having an oxadiazole. skeleton (disclosed in Japanese Laid-Open Patent Publication No. 54-12742), azo pigments having a fluorenone skeleton (disclosed in Japanese Laid-Open Patent skeleton (disclosed in Japanese Laid-Open Patent Publication No. 54-22834), azo pigments having a bisstilbene skeleton (disclosed in Japanese Laid-Open Patent Publication No. 54-17733), azo pigments having a distyrylcarbazole skeleton (disclosed in Japanese Laid-Open Patent Publication No. 54-14967) and azo pigments having a benzanthrone skeleton; phthalocyanine pigments such as CI Pigment Blue 16 (CI 74100), oxotitaniumphthalocyanine, chlorogalliumphthalocyanine and hydroxygalliumphthalocyanine; indigo pigments such as CI Vat Brown 5 (CI 73410) and CI Vat Dye (CI 73030); and perylene pigments such as Algo Scarlet B (Bayer), Indanthrene Scarlet R(Bayer), squaric dyes, hexagonal Se powders, etc.

These charge generation materials are pulverized and dispersed with a solvent such as tetrahydrofuran, cyclohexanone, dibxane and dichloroethane by a ball mill, an attritor, a sand mill, etc. At this time, a binder resin such as polyamide, polyurethane, polyester, epoxy resins, polyketone, polycarbonate, silicone resins, acrylic resins, polyvinylbutyral, polyvinylformal, polyvinylketone, polystyrene, poly-N-vinylcarbazole and polyacrylamide may be included in the mixture. The thus prepared charge generation layer forming liquid is coated and by a bead coating, a die coating, a blade coating, a spray coating method, etc. and dried to form a charge generation layer. The content of the binder resin in the charge generation layer is preferably not greater than 40% by weight based on total weight of the charge generation material.

Specific examples of the charge transport material include compounds including polycyclic aromatic compounds such as anthracene, pyrene, phenanthrene and coronene or cyclic compounds including a nitrogen atom such as indole, carbazole, oxazole, isooxazole, thiazole, imidazole, pyrazole, oxadiazole, pyrazoline, thiadiazole and triazole in their main or side chain; triphenyl amine compounds; hydrazone compounds (disclosed in Japanese laid-Open Patent Publication No. 55-46760), α-phenylstilbene compounds (disclosed in Japanese laid-Open Patent Publication No. 58-198043), etc. These charge transport materials are dissolved in a solvent such as tetrahydrofuran, cyclohexanone, dioxane and dichlorethane with a thermoplastic or thermosetting resin such as polystyrene, styrene-acrylonitrile copolymers, styrene-butadiene copolymers, styrene-maleic anhydride copolymers, polyesters, polyvinyl chloride, vinyl chloride-vinyl acetate copolymers, polyvinyl acetate, polyvinylidene chloride, polyarylates, phenoxy resins, polycarbonates, cellulose acetate resins, ethyl cellulose resins, polyvinyl butyral resins, polyvinyl formal resins, polyvinyl toluene, poly-N-vinyl carbazole, acrylic resins, silicone resins, epoxy resins, melamine resins, urethane resins, phenolic resins and alkyd resins to prepare a charge transport layer forming liquid. The liquid is coated by a bead coating, a die coating or a spray coating method, and dried to form a charge transport layer.

A multi-layered photosensitive layer including a charge generation layer and a charge transport layer has been explained, and a single-layered photosensitive layer may be used.

2. Intermediate Transfer Belt

After an electrostatic latent image on a photoreceptor is developed to form a toner image, an intermediate transfer belt receives the toner image and transfers the final toner image onto a receiving material such as papers. It is essential that the material used for the intermediate transfer belt does not easily become loose and does not prevent a smooth rotation of the intermediate transfer belt.

The material preferably has a linear elasticity of from $2\times10^2$ to $3\times10^5$ MPa, more preferably from $6\times10^2$ to $3\times10^5$ MPa, and furthermore preferably from $8.5\times10^2$ to $3\times10^5$.

Specific examples of the materials include resin materials including polyvinylidene fluoride, ethylene-ethylenetetrafluoride copolymers, polyimide, polycarbonate and the like, and a dispersed electroconductive material such as carbon black therein. In the present invention, a liquid material including polyvinyliderie fluoride and carbon black dispersed therein is injected into a cylinder rotating at a high speed; and heated, dried and hardened to form an endless belt, and then the endless belt is removed from the cylinder and an edge of the belt is cut to form an intermediate transfer belt. These are not limited and a rubber or a rubber including a fluorine atom can be used.

3. Fixing Belt

A heat roll fixing method is known as a method of fixing a toner image on a transfer sheet in an electrophotographic apparatus. In this method, a heat roller and a press roller are located facing each other, and a transfer sheet is fed between the rollers. A toner image transferred onto the transfer sheet is melted and fixed thereon with heat emitted from a heater in the heat roller, and pressure is applied to the image by the press roller to firmly fix the image on the transfer sheet. Since the beat roll fixing method has a small contact area of the rollers, the pressure load has to be increased to fix a toner image on a transfer sheet. In addition, when the copy speed is over 10 ppm due to the recent demand for high-speed printing, the pressure load has to be further increased and a toner release layer of the roll surface is significantly abraded, resulting in occurrence of offset problems in a short life.

Against these problems of heat roller fixing methods, a belt fixing method is suggested. In this belt fixing method, a roller and a release layer of a belt surface are located facing each other, and a transfer sheet is fed between them to fix a toner image. Even in this method, basic functions of pressurizing, heating, driving and releasing are necessary similarly to the heat roller fixing method, but either of the roll or the belt may have this function. In this manner, such a belt can increase the contact area, decrease the pressure load and increase the copy speed.

A fixing belt is preferably a heat-resistant endless belt including a release layer formed of a fluorocarbon resin on a surface thereof.

The heat-resistant endless belt preferably has a thickness of from 5 to 200 μm.

The heat-resistant endless belt preferably has a heat resistance of from a temperature used for fixing to a deformation temperature (ASTM:D648) 200° C. (1.8 MPa), and a material thereof is preferably a resin or a metal which is not resolved at from 300 to 430° C. at which a fluorocarbon resin is melted, and which further has a good elasticity. Specific examples of the material include a heat-resistant resin such as polyimide, polyamideimide, polyetheretherketone, polyphenylenesulfide and polybenzimidazole; and a metal such as aluminium, iron, nickel and their alloyed metal.

Among these materials, the polyimide resin having good mechanical properties, a heat resistance and an elasticity is most preferably used. The polyimide resin can be formed by, e.g., dissolving an acid component of a tetracarboxylic acid dianhydride and an amine component of diamine in substantially the same molar amount as that of the acid component in a proper solvent to prepare a polyamide acid liquid, and drying the solvent and polymerizing (imide conversion) at a high temperature.

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

1. Preparation for a Sheet-Shaped Photoreceptor

First, a method of preparing a sheet-shaped photoreceptor for use both in Examples and Comparative Examples will be explained.

Substrate

A plastic film including a polyethyleneterephthalate having a thickness of 100 μm and an aluminium having a thickness of 1,000 Å evaporated thereon was used as a substrate.

Formation of an Undercoat Layer

The following materials were dispersed in a ball mill for 48 hrs to prepare a dispersion liquid.

| | |
|---|---|
| Titanium oxide powder | 15 |
| Alcohol-soluble nylon resin | 3 |
| Methyl ethyl ketone | 75 |

The dispersion liquid was diluted with 75 parts of methyl ethyl ketone to prepare an undercoat layer coating liquid.

The undercoat layer coating liquid was coated on the above-mentioned substrate by a die coating method, and dried at 120° C. for 20 min to form an undercoat layer having a thickness of 2 μm.

Formation of a Charge Generation Layer

The following materials were milled in a ball mill for 72 hrs.

| | |
|---|---|
| Charge generation material having the following formula (I) | 10 |
| Polyvinylbutyral | 7 |
| Tetrahydrofuran | 145 |

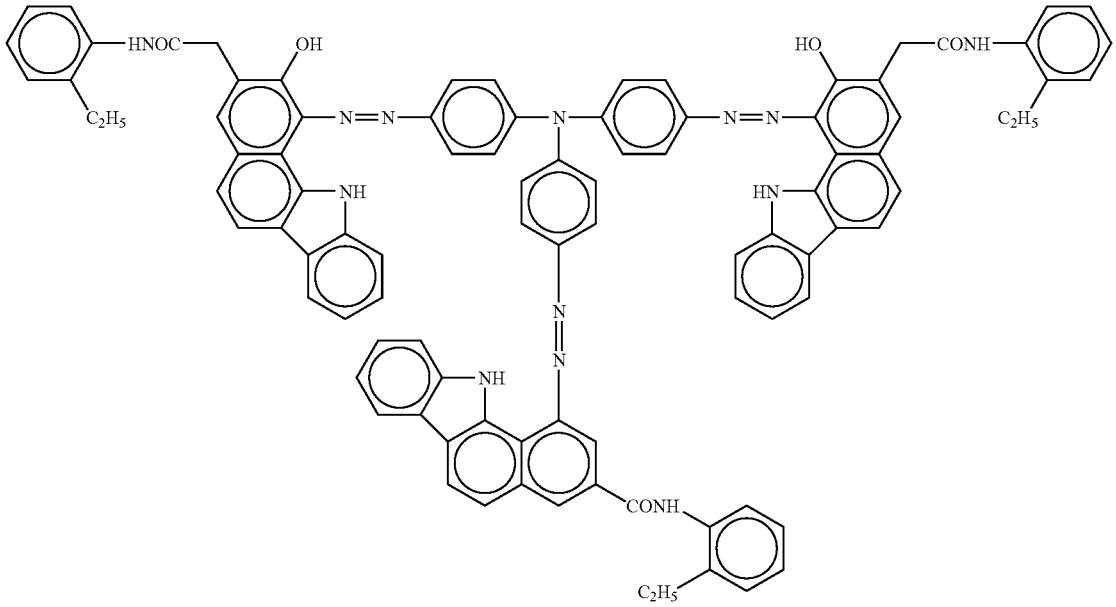

(I)

200 parts of cyclohexanone were further included in the mixture and the mixture was dispersed for 1 hr, and further diluted with cyclohexanone to prepare a charge generation layer coating liquid.

The charge generation layer coating liquid was coated on the above-mentioned substrate on which the undercoat layer was formed by a roll coating method, and dried at 100° C. for 10 min to form a charge generation layer on the undercoat layer of the substrate.

Formation of a Charge Transport Layer

A charge transport layer coating liquid was prepared by dissolving the following materials.

| | |
|---|---|
| Charge transport material having the following formula (II) | 7 |

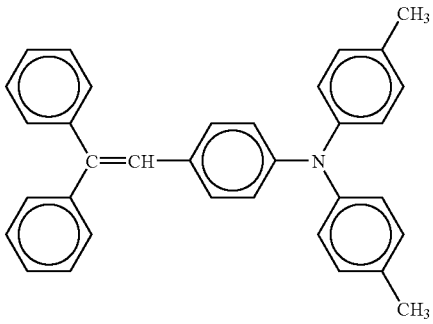

(II)

-continued

| | |
|---|---|
| polycarbonate (PanliteC-1400 from Teijin Limited) | 10 |
| tetrahydrofuran | 83 |
| Silicone oil | 0.001 |

The charge transport layer coating liquid was coated on the above-mentioned substrate on which the charge generation layer was formed by a die coating method, and dried at 120° C. for 30 min to form a charge transport layer having a thickness of 28 μm on the charge generation layer of the substrate. The thus prepared sheet-shaped photoreceptor had a total thickness of 130 μm.

The sheet-shaped photoreceptors were combined by a ultrasonic boding method to prepare an endless belt-shaped photoreceptor having a width of 425 mm and a peripheral length of 3,820 mm, and the endless belt-shaped photoreceptor (endless belt) was packed in a method of the following Examples and Comparative Examples.

2. Packing of the Endless Belt-Shaped Photoreceptor (Endless Belt)

Example 1

The endless belt-shaped photoreceptor (endless belt) was put on a desk as FIG. 1A shows. Two (cylindrical) paper tubes having an outer diameter of 60 mm were located at both inside ends of the belt as FIG. 1B shows and a (cylindrical) paper tube having an outer diameter of 85 mm was located as FIG. 1C shows. As shown from FIGS. 1D to 1F, the belt was wound to prepare a package. The three tubes were spiral paper tubes whose surfaces were polished. The maximum Rmax and an average Rmax of ten locations of each paper tube, i.e., total 30 locations were 76 μm and 52 μm.

Next, the package was fixed using 4 buffers for packing shown in FIG. 4 at an interval of 28 mm. Then, the photoreceptor was covered with a black paper having a thickness of 0.05 mm and put in a corrugated box.

The number of winding times of the belt in Example 1 was three. Therefore, the above-mentioned formula (1): $L=2\times A\times(n+1)$ was $2\times0.13\times(3+1)=1.04$. Since the interval of the paper tubes was 28 mm, Example 1 satisfies the conditions of the formula (1). A is a thickness of the belt and n is a winding number.

The contact pressure between the belt-shaped photoreceptor (endless belt) and the tubes measured by Prescale from Fuji Photo Film Co., Ltd. was a measurable minimum of not greater than 0.2 MPa.

Example 2

The procedure for the preparation for a package in Example 1 was repeated except for using three paper tubes having the maximum Rmax and an average Rmax of ten locations of each paper tube, i.e., total 30 locations were 138 μm and 78 μm.

Next, the package was fixed using 4 buffers as it was in Example 2. Then, the photoreceptor was covered with a black paper having a thickness of 0.05 mm and put in a corrugated box.

The number of winding times of the belt in Example 2 was three. Therefore, the above-mentioned formula (1): $L=2\times A\times(n+1)$ was $2\times0.13\times(3+1)=1.04$. Since the interval of the paper tubes was 28 mm, the package in Example 2 satisfies the conditions of the formula (1).

The contact pressure between the belt-shaped photoreceptor (endless belt) and the tubes measured by Prescale from Fuji Photo Film Co., Ltd. was a measurable minimum of not greater than 0.2 MPa.

Example 3

The procedures of preparation for a package in Example 1 was repeated except for using three paper tubes having the maximum Rmax and an average Rmax of ten locations of each paper tube, i.e., total 30 locations were 124 μm and 35 μm.

Next, the package was fixed using 4 buffers as in Example 1. Then, the photoreceptor was covered with a black paper having a thickness of 0.05 mm and put in a corrugated box.

The number of winding times of the belt in Example 3 was three. Therefore, the above-mentioned formula (1): $L=2\times A\times(n+1)$ was $2\times0.13\times(3+1)=1.04$. Since the interval of the paper tubes was 28 mm, the package in Example 3 satisfies the conditions of the formula (1).

The contact pressure between the belt-shaped photoreceptor (endless belt) and the tubes measured by Prescale from Fuji Photo Film Co., Ltd. was a measurable minimum of not greater than about 0.2 MPa.

Example 4

The endless belt-shaped photoreceptor (endless belt) was put on a desk as FIG. 1A shows. Two (cylindrical) paper tubes having an outer diameter of 85 mm were located at both inside ends of the belt as FIG. 1B shows and a (cylindrical) paper tube having an outer diameter of 85 mm was located as FIG. 1C shows. As shown from FIGS. 1D to 1F, the belt was wound. Next, the middle paper tube was removed to prepare a package and the package was put in a corrugated box. The maximum Rmax and an average Rmax of ten locations of each paper tube, i.e., total 20 locations were 76 μm and 52 μm.

The contact pressure between the belt-shaped photoreceptor (endless belt) and the tubes measured by Prescale from Fuji Photo Film Co., Ltd. was a measurable minimum of not greater than 0.2 MPa.

Comparative Example 1

The procedures for the preparation for a package in Example 1 were repeated except for using three paper tubes having the maximum Rmax and an average Rmax of ten locations of each paper tube, i.e., total 30 locations were 167 μm and 117 μm.

Next, the three tubes were extended such that a contact pressure between the photoreceptor (endless belt) and the tubes was about 0.6 MPa and the package was fixed using 4 buffers for packing shown in FIG. 4. Then, the photoreceptor was covered with black paper having a thickness of 0.05 mm and put in a corrugated box.

The contact pressure between the belt-shaped photoreceptor and the tubes was measured by Prescale from Fuji Photo Film Co., Ltd.

The number of winding times of the belt in Comparative Example 1 was three. Therefore, the above-mentioned formula (1): $L=2\times A\times(n+1)$ was $2\times0.13\times(3+1)=1.04$. Since the interval of the paper tubes was 28 mm, Comparative Example 1 satisfies the conditions of the formula (1).

Comparative Example 2

The procedures of preparation for a package in Example 1 were repeated except for using three paper tubes having the maximum Rmax and an average Rmax of ten locations of each paper tube, i.e., total 30 locations were 247 μm and 172 μm.

Next, the three tubes were extended such that a contact pressure between the photoreceptor and the tubes was about 0.6 MPa and the package was fixed using 4 buffers for packing shown in FIG. 4. Then, the photoreceptor was covered with a black paper having a thickness of 0.05 mm and put in a corrugated box.

The contact pressure between the belt-shaped photoreceptor and the tubes was measured by Prescale from Fuji Photo Film Co., Ltd.

The number of winding times of the belt in Comparative Example 2 was three. Therefore, the above-mentioned formula (1): $L=2\times A\times(n+1)6$ was $2\times0.13\times(3+1)=1.04$. Since the interval of the paper tubes was 28 mm, Comparative Example 2 satisfies the conditions of the formula (1).

Comparative Example 3

The procedures of preparation for a package in Example 1 was repeated except for using three paper tubes having the maximum Rmax and an average Rmax of ten locations of each paper tube, i.e., total 30 locations were 337 μm and 172 μm.

Next, the package was fixed using 4 buffers as it was in Example 1. Then, the photoreceptor was covered with black paper having a thickness of 0.05 mm and put in a corrugated box.

The contact pressure between the belt-shaped photoreceptor and the tubes measured by Prescale from Fuji Photo Film Co., Ltd. was a measurable minimum of not greater than about 0.2 MPa.

The number of winding times of the belt in Comparative Example 3 was three. Therefore, the above-mentioned formula (1): $L=2\times A\times(n+1)$ was $2\times0.13\times(3+1)=1.04$. Since the interval of the paper tubes was 28 mm, Comparative Example 3 satisfies the conditions of formula (1).

Comparative Example 4

The procedures of preparation for a package in Example 1 were repeated except for using three paper tubes having the maximum Rmax and an average Rmax of ten locations of each paper tube, i.e., total 30 locations were 173 μm and 127 μm.

Next, the three tubes were fixed such that they were as close as possible to one another sandwiching the belt. Then, the photoreceptor was covered with black paper having a thickness of 0.05 mm and put in a corrugated box.

The contact pressure between the belt-shaped photoreceptor and the tubes measured by Prescale from Fuji Photo Film Co., Ltd. was a measurable minimum of not greater than about 0.2 MPa.

The number of winding times of the belt in Comparative Example 4 was three. Therefore, the above-mentioned formula (1): $L=2\times A\times(n+1)$ was $2\times0.13\times(3+1)=1.04$. Since the interval of the paper tubes was 28 mm, Comparative Example 4 satisfies the conditions of the formula (1).

The belt-shaped photoreceptors packed in Examples 1 to 4 and Comparative Examples 1 to 4 were left in an environment having a temperature of 20±5° C. and a relative humidity of 60±10% for 5 days. Then, the belt-shaped photoreceptors were unpacked to visually observe whether they had a concavity and convexity or a damage. When the belt-shaped photoreceptor was visually observed whether it had a concavity and convexity or a damage, it was put on a flat desk and inspected whether a fluorescent light on a ceiling could be seen without a distortion. The results are shown in Table 1.

Next, the belt-shaped photoreceptors were sequentially installed in an electrophotographic apparatus, and halftone images were produced to see whether they had a defective image. The results are shown in Table 1.

Finally, the belt-shaped photoreceptor was picked out from the apparatus and the circumference thereof was visually observed. A portion supposed to have the largest concavity and convexity or damage was cut out in a size of 15 cm×30 cm to measure the concavity and convexity or damage with a non-contact surface location measurer from Ricoh Company, Ltd. The apparatus has a laser sensor of a laser displacement gauge LC-2100 from Keyence Corp. instead of a pen of an XY plotter from Graphtec Corp. to measure a displacement on a surface of an object by scanning the surface thereof in the XY direction. The maximum displacement in a range of 100 mm×100 mm was measured using the apparatus.

Figure 10:
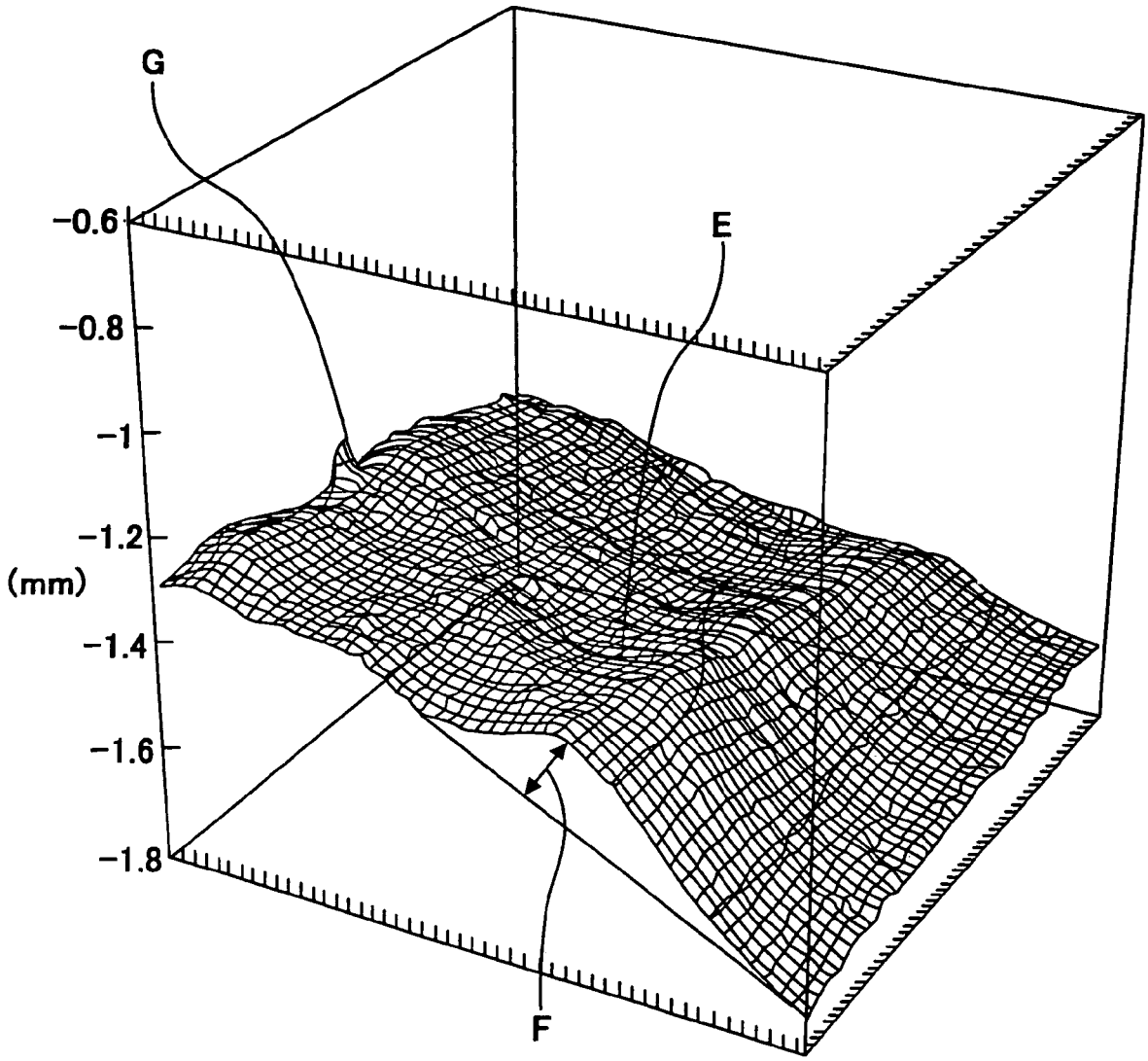
FIG. 10 is a schematic view illustrating a result of measuring a surface concavity and convexity of a photoreceptor belt.

The measurement results are shown in the three-dimensional graph in FIG. 10. In FIG. 10, displacements of the belt were measured at an interval of 5 mm, and the belt had a declination toward the right and a stripe convexity (E in FIG. 10). The declination toward the right is a declination of the whole belt and the stripe convexity is a spiral trace of the spiral paper tube used. A height F, i.e., a difference between a peak and a foot of a surface displacement in FIG. 10 was determined as a displacement amount. In FIG. 10, a peak G supposed to be caused by a dust adherence was excluded from the displacement measurement. The measurement results are shown in Table 1.

TABLE 1

| | Visual inspection | Image production | Max. surface displacement |
|---|---|---|---|
| Ex. 1 | Normal | Normal | 0.12 mm |
| Ex. 2 | Normal | Normal | 0.15 mm |
| Ex. 3 | Normal | Normal | 0.26 mm |
| Ex. 4 | Normal | Normal | 0.32 mm |
| Com. Ex. 1 | Apparent concavity and convexity in accordance with those of the spiral paper tube. | Oblique white line | 1.4 mm |
| Com. Ex. 2 | Apparent concavity and convexity in accordance with those of the spiral paper tube. | Oblique white line | 1.6 mm |
| Com. Ex. 3 | Apparent concavity and convexity in accordance with those of the spiral paper tube. | Oblique white line | 1.8 mm |
| Com. Ex. 4 | Apparent concavity and convexity in accordance with those of the spiral paper tube. Besides this, concavities and convexities were wholly present. | Oblique white line White lines were wholly present | 2.1 mm |

Table 1 shows that Examples 1 to 4 were normal in terms of visual inspection, image production and surface displacement.

This document claims priority and contains subject matter related to Japanese Patent Applications Nos. 2001-395320 and 2002-069617 filed on Dec. 26, 2001 and Mar. 14, 2002 respectively, the disclosure of each of which is incorporated herein by reference.

Having now fully described the invention, it will be apparent to one of ordinary skill in the art that many changes and modifications can be made thereto without departing from the spirit and scope of the invention as set forth therein.

What is claimed as new and desired to be secured by Letters Patent of the United States is:

1. A method of forming a package, comprising:

inserting a first and a second cylindrical body into an endless belt such that each of the first and second cylindrical bodies contacts an inner surface of the endless belt;

setting a third cylindrical body next to the first cylindrical body such that the third cylindrical body contacts an outer surface of the endless belt; and rotating a combination of the first and third cylindrical bodies toward the second cylindrical body to wind the endless belt around the first, second, and third cylindrical bodies such that the first, second, and third cylindrical bodies are arranged so as to be parallel to each other and substantially located in one plane, wherein a distance between each of the first, second, and third cylindrical bodies is not less than a value (L) determined by the following formula:

$$L=2\times T\times(n+1)$$

wherein T is a thickness of the endless belt and n is a winding number of the endless belt.

2. The method of claim 1, further comprising:

removing the first or third cylindrical body located between the other two cylindrical bodies.

3. The method of forming a package of claim 1, comprising:

inserting the first and the second cylindrical body, each having a length that is 5 to 100 mm longer than a width of the endless belt, into the endless belt; and setting the third cylindrical body, having a length that is 5 to 100 mm longer than the width of the endless belt, next to the first cylindrical body.

4. The method of forming a package of claim 1, comprising:

inserting the first and the second cylindrical body, each having a length that is 30 to 80 mm longer than a width of the endless belt, into the endless belt; and setting the third cylindrical body, having a length that is 30 to 80 mm longer than the width of the endless belt, next to the first cylindrical body.

5. The method of forming a package of claim 1, comprising:

inserting the first and the second cylindrical body, each having a maximum surface height of from 0.8 to 150 micrometers when measured by a method based on JIS B 0601, into the endless belt; and setting the third cylindrical body, having a maximum surface height of from 0.8 to 150 micrometers when measured by a method based on JIS B 0601, next to the first cylindrical body.

6. The method of forming a package of claim 1, further comprising:

inserting a spacer to maintain the distance between the first and third cylindrical bodies.

* * * * *